US007171886B2

(12) United States Patent
Herrmann et al.

(10) Patent No.: US 7,171,886 B2
(45) Date of Patent: Feb. 6, 2007

(54) PIPE MORTAR

(75) Inventors: Ralf-Joachim Herrmann, Senzig (DE); Henning von Seidlitz, Neuss (DE); Marold Elspass, Kaarst (DE); Rolf Bartolles, Korschenbroich (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/400,921

(22) Filed: Mar. 28, 2003

(65) Prior Publication Data

US 2004/0007873 A1 Jan. 15, 2004

(30) Foreign Application Priority Data

Mar. 28, 2002 (DE) ..... 102 13 928

(51) Int. Cl.
*F41A 3/74* (2006.01)
*F16J 15/02* (2006.01)

(52) U.S. Cl. ..... 89/26; 89/16; 89/37.05; 277/644

(58) Field of Classification Search ..... 277/647, 277/626, 644; 89/26, 1, 3, 37.05, 37.13, 89/16

See application file for complete search history.

(56) References Cited

U.S. PATENT DOCUMENTS 1,480,957 A * 1/1924 Schneider ..... 89/1.3
2,307,009 A * 1/1943 Adelman ..... 89/1.3
2,468,134 A * 4/1949 Swipp ..... 89/26
2,998,755 A * 9/1961 Thierry ..... 89/26
3,125,928 A * 3/1964 Bartels ..... 89/26
3,207,524 A * 9/1965 Trbovich ..... 277/647
3,403,596 A * 10/1968 Bartels ..... 89/26
3,547,001 A * 12/1970 Stoner ..... 89/156
3,572,729 A * 3/1971 Hodil, Jr. ..... 277/647
3,713,660 A * 1/1973 Luthe ..... 277/644
3,799,560 A * 3/1974 Stearns et al. ..... 277/628
4,566,368 A * 1/1986 Bartolles ..... 89/26
4,709,616 A * 12/1987 Bartolles ..... 89/26
4,744,283 A * 5/1988 Ibarra ..... 89/27.12

(Continued)

FOREIGN PATENT DOCUMENTS

EP 0 178 284 4/1986

(Continued)

*Primary Examiner*—Alison K. Pickard
(74) *Attorney, Agent, or Firm*—Venable LLP; Stuart I. Smith; Ryan M. Flandro

(57) ABSTRACT

To seal a pipe mortar, a sealing element (3, 6) is inserted between the pipe (1) and the base (2), with the element elastically balancing out the axial relative movements between the pipe (1) and the base (2). The sealing element (3) is preferably prestressed, with the gas pressure supporting the sealing effect. The sealing element (3, 6) can be a U-shaped or L-shaped steel ring. In the U-shaped sealing element (3), the legs (3.1) are axially prestressed to the extent that the sealing ring (3) and the pipe (1) or the base (2) are pressed together to produce an adequate seal. In the L-shaped sealing element (6), the inside leg (6.1) produces the gas-tight connection when the pipe (1) and the base (2) are screwed together. A sealing lips (6.2) of the sealing ring (6) elastically absorbs changes in length between the pipe and the base that occur during firing.

3 Claims, 1 Drawing Sheet

U.S. PATENT DOCUMENTS 5,054,366 A * 10/1991 Bartolles ..... 89/26
5,147,971 A * 9/1992 Bartolles ..... 89/26
5,297,491 A * 3/1994 Sippel et al. ..... 102/469
5,305,679 A * 4/1994 Begneu ..... 89/26
5,354,072 A * 10/1994 Nicholson ..... 277/647
5,730,445 A * 3/1998 Swensen et al. ..... 277/647
5,777,256 A * 7/1998 Simon et al. ..... 89/26
6,363,829 B1 * 4/2002 Franchino et al. ..... 89/26

FOREIGN PATENT DOCUMENTS

EP 0251902 A1 * 1/1988

* cited by examiner

PIPE MORTAR

CROSS REFERENCE TO RELATED APPLICATION

This application claims the priority of German Patent Application DE 102 13 928.8 filed Mar. 28, 2002, which is incorporated herein by reference.

BACKGROUND OF THE INVENTION

The invention relates to a seal for the pipe and base, or floor piece, of mortars or grenade launchers that operate in accordance with the front-loading principle.

Screwing the pipe and base or floor piece together creates an axial prestress force that brings axial annular surfaces into contact with one another, thus producing a seal. An additional copper ring is often used. Mortars that operate in accordance with the front-loading principle are typically placed on the ground for firing. Depending on the ground surface, various types of recoil travel and recoil acceleration may occur. If the ground surface is very soft, the recoil acceleration may cause the forces to be transmitted from the thread to increase to the point that the sealing surfaces separate from one another. The relatively low axial flexibility of the screw connection in particular contributes to this.

SUMMARY OF THE INVENTION

It is the object of the invention to avoid the above drawback.

The object generally is achieved by a pipe mortar having a pipe and a base that are screwed together and between which axial relative movements occur during firing; and wherein a sealing element is inserted between the pipe and the base, and has an elastic deformity that balances out the axial relative movement between the pipe and the base.

The invention is based on the idea of inserting a sealing element between end surfaces of the pipe and the base for balancing out the axial relative movement between the pipe and the base through elastic deformation. According to the specifically disclosed embodiments, the seal is disposed to a portion of the end surface that extends to the interior surface of the pipe.

The sealing element is preferably prestressed. This prestress, supported by the gas pressure, produces the sealing effect.

Advantageous embodiments are disclosed.

The seal is produced according to and embodiment by a steel ring whose preferably U-shaped cross-sectional surface is open toward the inside or center of the ring and pipe. In the creation of the screw connection, the legs of the ring are axially prestressed to the extent that the sealing ring and the pipe or the base are pressed together to produce an adequate seal, even when maximum relative movements occur between the pipe and the floor piece or base. The opening of the sealing-ring profile toward the inside augments the sealing effect produced by the gas pressure acting in the sealing ring.

As an alternative, the sealing element can be formed as an L-shaped angle sealing ring L-shaped likewise comprising steel and can be pressed into the pipe and base, respectively, thereby forming a loose press-fit. The two legs of the ring, which are L-shaped, then produce the gas-tight connection when the pipe and the base are screwed together. Sealing lips of the ring elastically absorb changes in length between the pipe and the floor piece that occur in the X- and Y-axes during firing.

The above sealing elements create a seal between the pipe and the base or floor piece, which prevents gas leakage and associated washouts. Furthermore, the seal prevents the penetration of powder gases and severe contamination. The construction also facilitates disassembly.

The invention is described in detail by an exemplary embodiments shown in the Drawings.

DETAILED DESCRIPTION OF THE INVENTION

Figure 1:
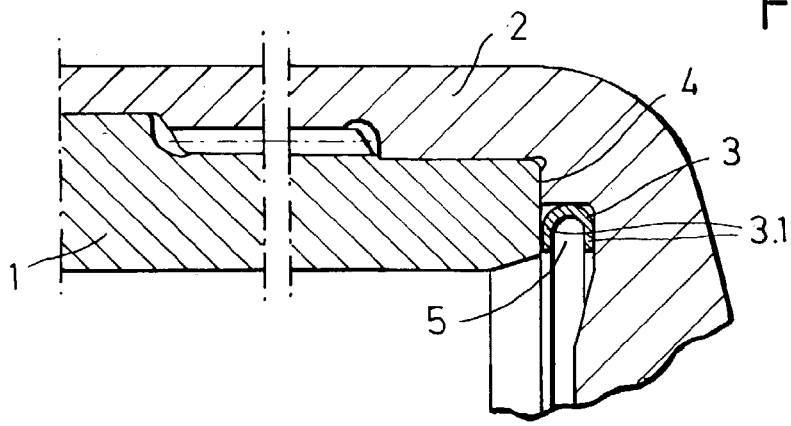
FIG. 1 is a cutout representation of a sealing ring according to the invention between a pipe and a base or floor piece, with the ring being mounted in the base.

The figures illustrate a pipe 1, a base or floor piece 2, sealing rings 3 and 6, and end surfaces 4 of the pipe 1 and of the base 2 of a mortar or grenade launcher, not shown in further detail.

The pipe 1 and the base 2 are screwed together in a known manner via the schematically shown screw connection.

Figure 2:
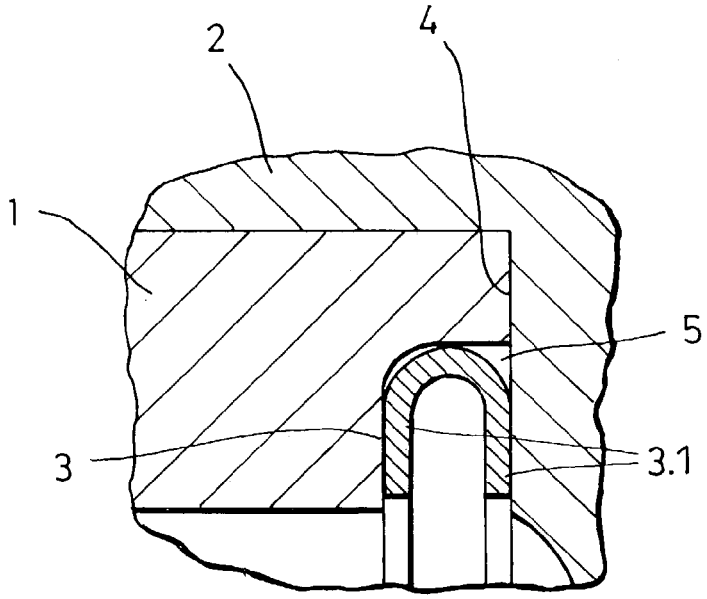
FIG. 2 is a further cutout representation of the sealing ring according to FIG. 1, with the ring being mounted in the pipe according to the invention.

As shown in FIGS. 1 and 2, a sealing ring 3 having a U-shaped cross section that is toward the interior of the ring is positioned between portions of the end surfaces 4 of the pipes 3 and base 2 and extend to the interior surface of the pipe. Thus, the U-shaped ring 3 is also open to the interior of the pipe 1. The legs 3.1 of the U-shaped cross-section of the sealing ring 3 thus are compressed, and clamped together by the end surfaces 4 of the pipe 1 and the base 2. If the end surfaces 4 separate due to recoil acceleration, the seal is still effected between the elastically prestressed legs 3.1 of the sealing ring 3 and the pipe 1 and the base 2, respectively. The gas pressure in the pipe 1, against which the seal acts, dominates between the legs 3.1 of the sealing ring 3, and thus supports the sealing effect.

In the embodiment of FIG. 1 the sealing ring 3 is inserted into a groove 5 in the end surface of base 2. In the embodiment of FIG. 2, the sealing ring 3 is located in a groove 5 in the end surface of the pipe 1.

Figure 3:
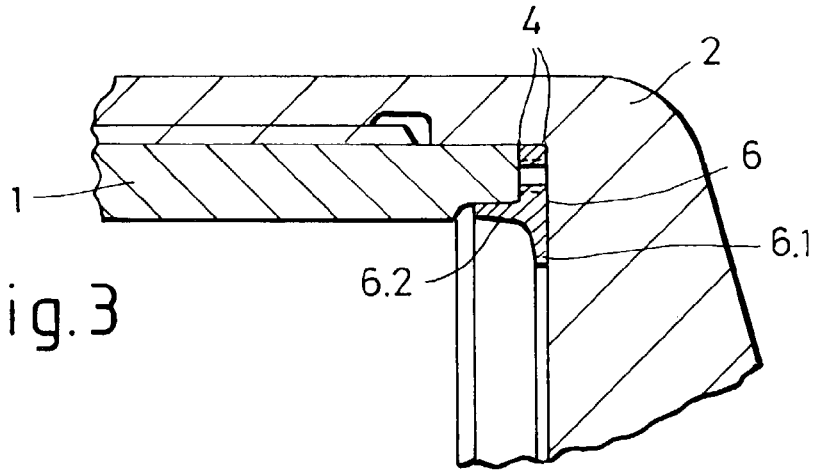
FIG. 3 is a cutout representation of a further embodiment of a sealing ring between the pipe and the base.

FIG. 3 shows a further embodiment of sealing ring 6, which is not U-shaped as in the case of FIGS. 1 and 2. The sealing ring 6 in this case is an angle ring of steel that is elastically clamped during firing and has legs 6.1 and 6.2 which result in an L-shaped cross section. At least a portion of the sealing ring 6 such as, for example, a radially outwardly extending portion, is held between and contacts the end surfaces 4 of the pipe 1 and the base 2 when the pipe 1 and the base 2 are screwed together. The ring 6 has a radially inwardly facing leg 6.1 that forms an angle of about 1° with respect to a plane perpendicular to a central axis defined by the ring 6 before the pipe 1 and the base 2 are screwed together. This angled inwardly facing leg 6.1 is pre-stressed by the base end surface to produce a gas-tight connection when the pipe 1 and the base 2 are screwed together. The ring 6 likewise has an axially extending sealing leg or lip 6.2 that elastically absorb changes in length between the pipe 1 and the base 2 that occur about the transverse (X) and longitudinal (Y)-axes.

The invention now being fully described, it will be apparent to one of ordinary skill in the art that many changes and modifications can be made thereto without departing from the spirit or scope of the invention as set forth herein.

What is claimed is:

1. A pipe mortar comprising:

a pipe and a base that are screwed together, between which axial relative movements occur during firing; and a sealing element having a radially outwardly extending portion disposed between and contacting end surfaces of the pipe and the base, the sealing element having an elastic deformity that balances out axial relative movement between the pipe and the base, wherein the sealing element is an angle sealing ring with an L-shaped cross-section, and is pressed onto one of the pipe and the base with a loose press-fit, with one leg of the ring extending radially inwardly and being prestressed by the base end surface to produce a gas-tight connection when the pipe and the base are screwed together, and with another leg of the ring extending axially in the form of a sealing lip to elastically absorb changes in length between the pipe and the base that occur in the transverse (X)- and axial (Y)-axes during firing.

2. The pipe mortar according to claim 1, wherein the radially inward extending leg comprises a sealing surface that contacts the base of the pipe mortar.

3. A pipe mortar comprising:

a pipe having an end surface;

a base having an end surface, the base being threadedly coupled to the pipe; and an annular sealing element press-fitted onto one of the pipe and the base, the sealing element having a radially outwardly extending portion disposed between and contacting the end surface of the pipe and the end surface of the base, the sealing element having an L-shaped cross-section including a first radially inwardly extending leg, the first leg of the sealing element being prestressed by the end surface of the base to produce a gas-tight connection when the pipe and the base are screwed together; and a second leg of the sealing element extending axially in the form of a sealing lip, wherein the sealing element is adapted to elastically deform to absorb axial relative movement between the pipe and the base during firing.

* * * * *